US006427382B2

(12) United States Patent
Gregoriou et al.

(10) Patent No.: US 6,427,382 B2
(45) Date of Patent: Aug. 6, 2002

(54) DUAL SAFETY-EDGE FOR AN OVERHEAD DOOR

(75) Inventors: Daniel J. Gregoriou, Kewaskum; Jeffrey Konetzki, Menomonee Falls; Joe M. Delgado, West Bend, all of WI (US)

(73) Assignee: Rytec Corporation, Jackson, WI (US)

( * ) Notice: Subject to any disclaimer, the term of this patent is extended or adjusted under 35 U.S.C. 154(b) by 0 days.

(21) Appl. No.: 09/923,495

(22) Filed: Aug. 6, 2001

Related U.S. Application Data

(63) Continuation-in-part of application No. 09/507,834, filed on Feb. 22, 2000, now Pat. No. 6,286,257.
(60) Provisional application No. 60/121,044, filed on Feb. 22, 1999.

(51) Int. Cl.[7] ..... E05F 15/02
(52) U.S. Cl. ..... 49/27
(58) Field of Search ..... 49/26, 27, 28; 200/61.43

(56) References Cited

U.S. PATENT DOCUMENTS

| | | | | |
|---|---|---|---|---|
| 3,303,303 | A | 2/1967 | Miller | |
| 3,315,050 | A | 4/1967 | Miller | |
| 3,462,885 | A | 8/1969 | Miller | |
| 4,143,367 | A | 3/1979 | Schestag | |
| 4,273,974 | A | 6/1981 | Miller | |
| 4,501,963 | A | 2/1985 | Perisic | |
| 4,676,293 | A | 6/1987 | Hanssen | |
| 4,924,214 | A | 5/1990 | Hill | |
| 4,944,116 | A | 7/1990 | Mewald | |
| 4,953,608 | A | 9/1990 | Larsson | |
| 5,027,552 | A | 7/1991 | Miller et al. | |
| 5,057,819 | A | 10/1991 | Valenti | |
| 5,141,044 | A | 8/1992 | Hying et al. | |
| 5,157,230 | A | 10/1992 | Blubaugh | |
| 5,198,974 | A | 3/1993 | Orsat | |
| 5,239,146 | A | 8/1993 | Blubaugh | |
| 5,299,617 | A | 4/1994 | Hying et al. | |
| 5,384,982 | A | 1/1995 | Galperin | |
| 5,438,798 | A | 8/1995 | Plamper et al. | |
| 5,566,504 | A | 10/1996 | Pitel | |
| 5,629,681 | A | 5/1997 | Duvall et al. | |
| 5,912,625 | A | 6/1999 | Scofield | |
| 5,921,026 | A | 7/1999 | Miller | |
| 6,286,257 | B1 * | 9/2001 | Gregoriou et al. | 49/27 |

FOREIGN PATENT DOCUMENTS

| | | | |
|---|---|---|---|
| DE | 2610559 | * 12/1976 | 49/27 |
| FR | 2663363 | * 12/1991 | 49/27 |

* cited by examiner

*Primary Examiner*—Jerry Redman
(74) *Attorney, Agent, or Firm*—Wallenstein & Wagner, Ltd.

(57) ABSTRACT

A door assembly comprising a door body having a bottom edge is disclosed. The door body is selectively movable up and down to open and close an opening. The door assembly further comprises a safety edge attached to the bottom edge of the door body, the safety edge being an extrudate extruded from a deformable material and comprising a first and second chamber formed in integrated cooperative redundancy in the extrudate, wherein the first chamber comprises a first sensor body and the second chamber comprises a second sensor body, each sensor body being responsive to an impact.

15 Claims, 6 Drawing Sheets

FIG. 6
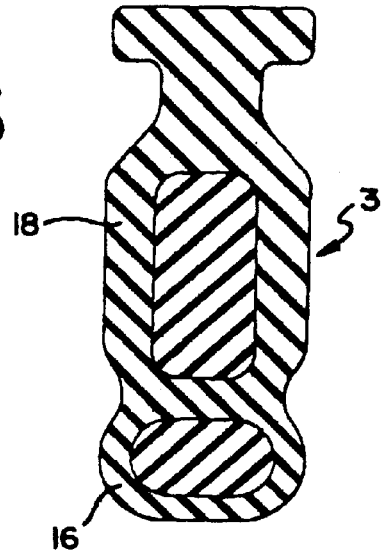
FIG. 7
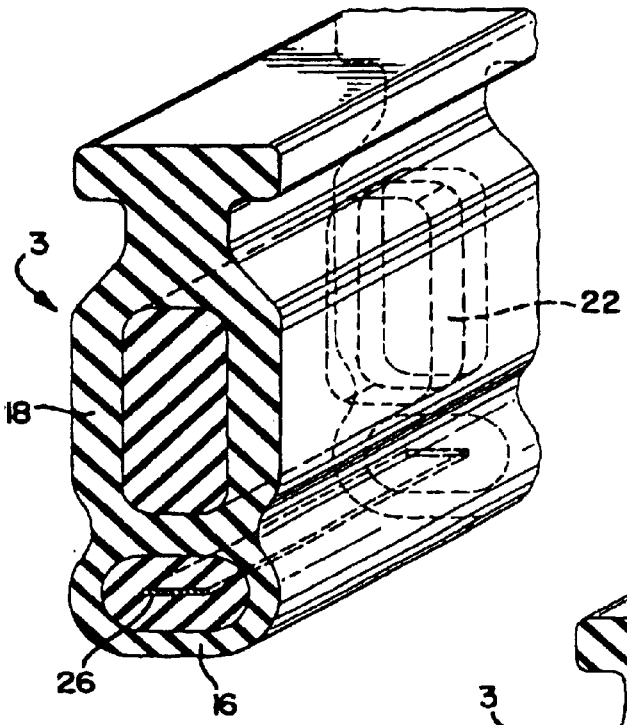
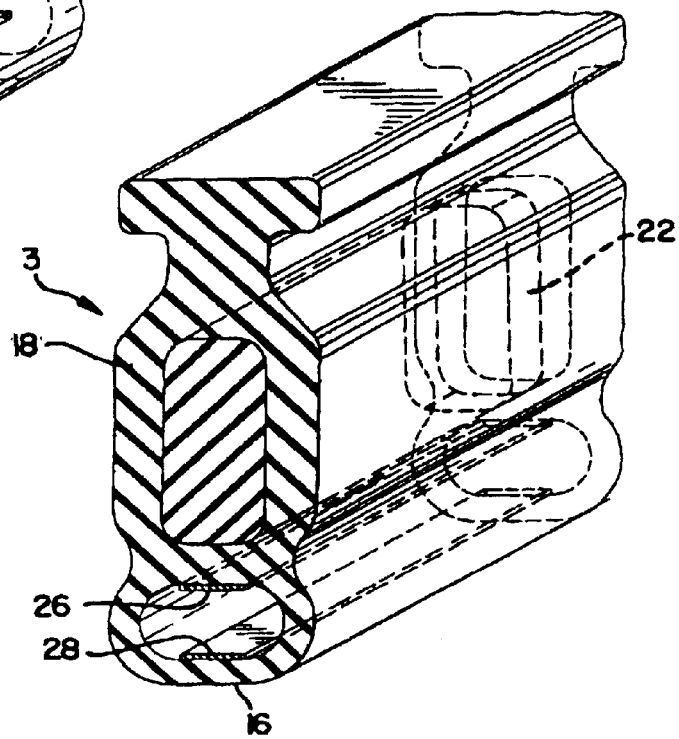
FIG. 8

DUAL SAFETY-EDGE FOR AN OVERHEAD DOOR

RELATED APPLICATIONS

This is a continuation-in-part of U.S. patent application Ser. No. 09/507,834, filed on Feb. 22, 2000 now U.S. Pat. No. 6,286,257 which claims the benefit of U.S. Provisional Application No. 60/121,044, filed Feb. 22, 1999.

TECHNICAL FIELD

The invention relates to industrial doors, in particular overhead industrial doors with closure safety mechanisms.

BACKGROUND OF THE INVENTION

Overhead doors have been used for many years to secure various enclosures including manufacturing plants, warehouses, garages, and other industrial doorways. It is well known in the art to provide a safety device on the leading edge of these doors to minimize both damage to the doors and potential injury to users when the door is closing. Such safety devices are generally coupled to a door controller. If the safety device encounters an impact, a signal is transmitted to the controller. The signal causes the door to act in a prescribed manner. For example, the controller may cause the door to stop or reverse direction. It is desirable to provide a safety edge that provides multi-directional sensitivity and allows for some degree of door over-travel.

Typically, safety edges of the type found in U.S. Pat. No. 3,462,885 to Miller are employed. In particular, the safety edge in the '885 Miller patent is comprised of a resiliently compressible structure. The resilient structure includes a pair of flexible contact strips which are electrically connected to a motor. Upon deflection of the resilient structure, the contact strips engage one another and transmit an electrical signal to the motor, resulting in stoppage or reversal of the door. Alternatively, pneumatically actuated safety edges may be employed. Pneumatically actuated safety edges consist of fluid-filled chambers which are coupled to pressure sensors. The pressure sensors are responsive to pulses or changes in fluid pressure within a chamber. While both of these safety edges assist in preventing damage to the door and provide some degree of safety to the users, there exist inherent limitations in both systems.

Specifically, safety edges such as those found in the '885 Miller patent are less sensitive to impact applied perpendicular to the door body than pneumatically actuated safety edges. Furthermore, safety edges such as those in the '885 Miller patent tend to allow for only minimal door over-travel. Pneumatically actuated safety edges, on the other hand, tend to be more sensitive to impact in multiple directions. However, like the safety edges described above, conventional pneumatically actuated safety edges typically allow for limited door over-travel.

To provide a degree of over-travel, the pneumatic chamber of such a safety edge would have to be particularly large. By increasing the size of the pneumatic chamber, however, the sensitivity of the safety edge would decrease as the safety edge would require a greater impact to actuate the safety feature. Alternatively, some degree of over-travel can be obtained by attaching multiple sensors one to the other. Such a system is shown in U.S. Pat. No. 5,921,026 to Miller. The '026 Miller patent employs an adjustable height sensing edge, wherein sensors are attached one to another in order to compensate for varying door heights. The system disclosed in the '026 Miller patent, however, requires multiple connectable sensors which result in increased manufacturing costs. Moreover, there exists the possibility of failure of the connecting members used to connect the sensors of the '026 Miller patent. Accordingly, the edge in the '026 Miller patent could also result in increased maintenance and replacement, as well costs associated with such maintenance and repair.

While the safety edges discussed above have been met with a reasonable degree of success, the present invention is provided to solve the problems discussed above and other problems, and to provide advantages and aspects not provided by prior doors of this type.

SUMMARY OF THE INVENTION

The present invention provides a safety edge for a door assembly having a door body with a bottom edge.

According to one aspect of the present invention, the safety edge is an extrudate extruded from a deformable material. The extrudate comprises a first and second chamber formed in integrated cooperative redundancy in the extrudate. The first chamber comprises a first sensor body and the second chamber comprises a second sensor body. Each sensor body is responsive to an impact.

According to another aspect of the present invention, the second sensor body is sufficiently rigid to absorb impact parallel to the safety edge without causing complete deformation of the second chamber, but sufficiently deformable to actuate the second pressure sensor upon receiving an impact perpendicular to the second sensor body.

According to yet another aspect of the present invention, a door assembly is provided in which one of the sensor bodies has a greater sensitivity to impact perpendicular to the sensor body. Likewise, the other of the sensor bodies has a greater sensitivity to impact parallel to the sensor body than the first sensor body.

According to still another aspect of the present invention, the type of the first sensor body with respect to the type of the second sensor body results in one of the sensor bodies having a greater sensitivity than the other sensor body.

Other advantages and aspects of the present invention will become apparent upon reading the following description of the drawings and detailed description of the invention.

BRIEF DESCRIPTION OF THE DRAWINGS

FIG. 6 is a end view of an embodiment of the dual safety edge having a first sensor body with a deflectable element;

FIG. 7 is a partial perspective view of an embodiment of the dual safety edge having a first sensor body with a deflectable element;

FIG. 8 is a partial perspective view of an embodiment of the dual safety edge having a first sensor body with a first and a second deflectable element; and, FIG. 9 is a partial perspective view of another embodiment of the dual safety edge having a first sensor body wherein the deflectable element is a conductive polymer that defines at least a portion of the first sensor body.

DETAILED DESCRIPTION

Figure 1:
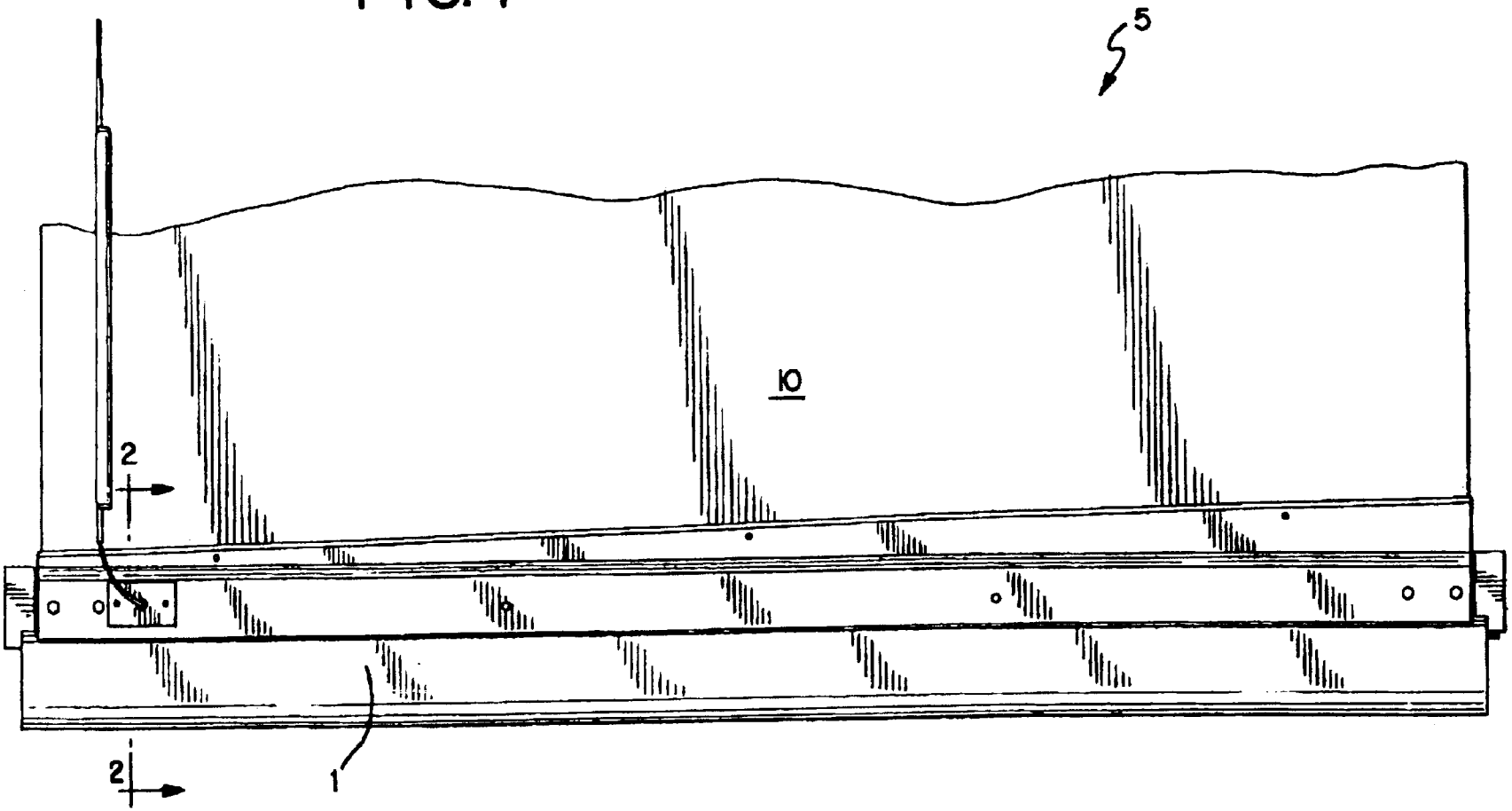
FIG. 1 is a front view of an overhead door assembly and dual safety edge according to the present invention.
Figure 2:
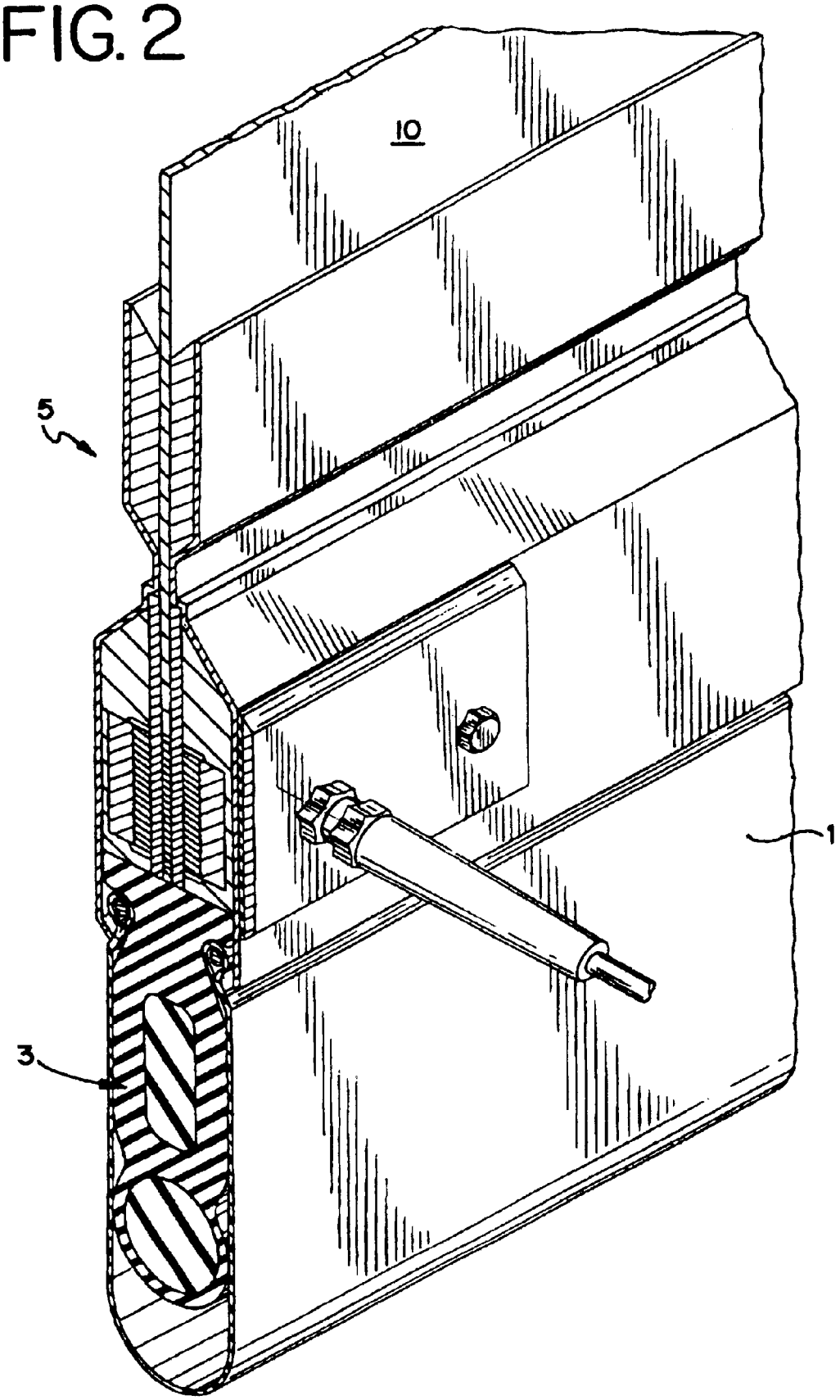
FIG. 2 is cross-section view, in perspective, of the overhead door assembly of FIG. 1 taken along the line 2—2.
Figure 3:
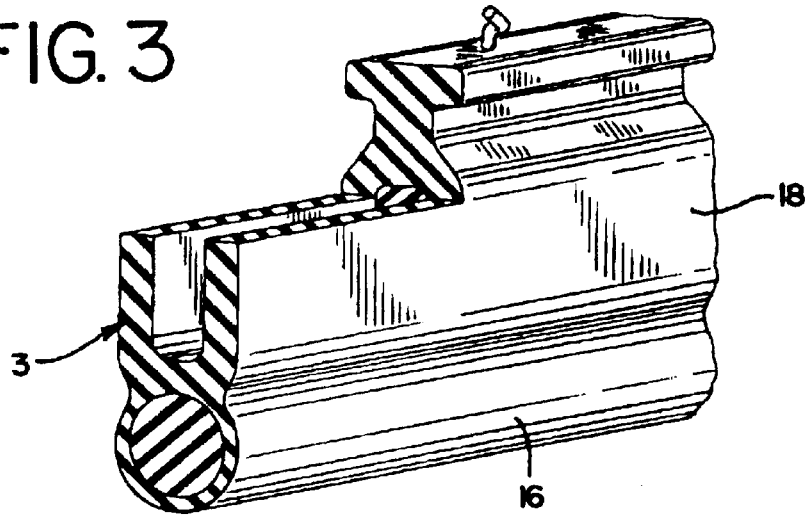
FIG. 3 is a partial front view of the dual safety edge of FIG. 1.
Figure 4A:
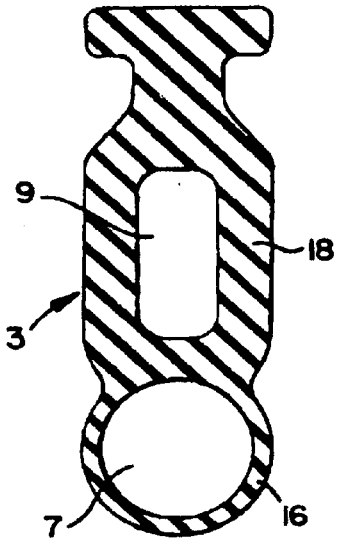
FIGS. 4A–C is a end view of a dual safety edge according to the present invention, illustrating deformation of the pneumatic chamber as a force applied to the safety edge from a direction parallel to the safety edge.
Figure 4B:
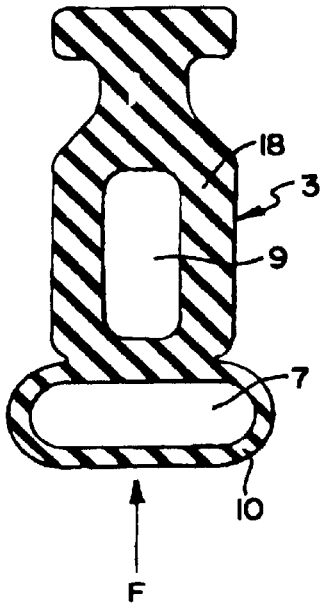
Figure 4C:
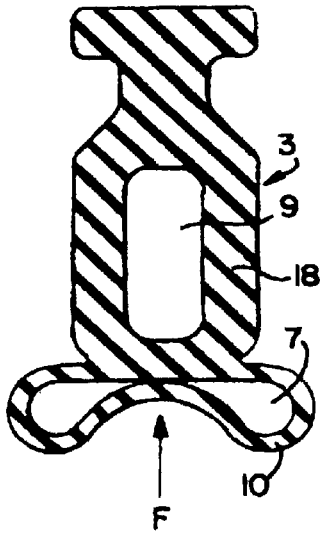

While this invention is susceptible of embodiment in many different forms, there is shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

FIGS. 1–9 disclose an improvement on previous safety edges for overhead door assemblies. In particular, the present invention contemplates combining sensor bodies, in a singular extrudate to provide an improved safety edge system for an overhead door with.

Specifically, FIGS. 1–9 disclose a safety edge 1 for a door assembly 5 comprising a door body 10 having a bottom edge 12. The door body 10 may be selectively moved up and down to open and close an opening. The safety edge 1 is an extrudate 3 extruded from a deformable resilient material. The extrudate 3 is comprised of a first chamber 7 and second chamber 9 formed in integrated cooperative redundancy in the extrudate 3. The first chamber 7 comprises a first sensor body 16 and the second chamber 9 comprises a second sensor body 18. According to the embodiment shown in FIGS. 1–5, each of the sensor bodies 16,18 is a pneumatic sensor body responsive to an impact. Furthermore, each of the sensor bodies 16,18 may be in communication with a door controller (not shown) such that the door body 10 responds (e.g., stops or reverses direction of travel) upon impact to the sensor bodies 16, 18.

In a preferred embodiment, each of the pneumatic sensor bodies 16,18 is in independent communication with the door controller. Accordingly, each of the pneumatic sensor bodies 16,18 works autonomously, and each generates a separate signal which is transmitted to the controller upon impact of a predetermined force to that sensor body 16,18.

One of the sensor bodies 16,18 has a greater sensitivity to an impact perpendicular to the sensor body 16,18, than the other sensor body 16,18. Likewise, the other of the sensors bodies 16,18 has a greater sensitivity to an impact parallel to the sensor body 16,18 than the sensor body 16,18 that is more sensitive to perpendicular impact. According to the present invention, this disparity in the sensitivity of the sensor bodies may be achieved by way of the various mechanisms described below.

Figure 5C:
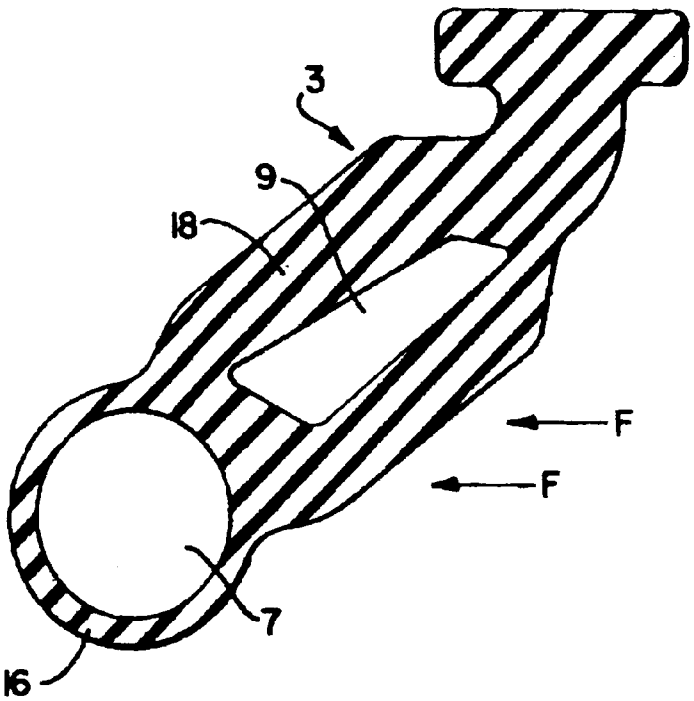
FIGS. 5A–C is a end view of a dual safety edge according to the present invention, illustrating deformation of the pneumatic chamber as a force applied to the safety edge from a direction perpendicular to the safety edge.
Figure 5B:
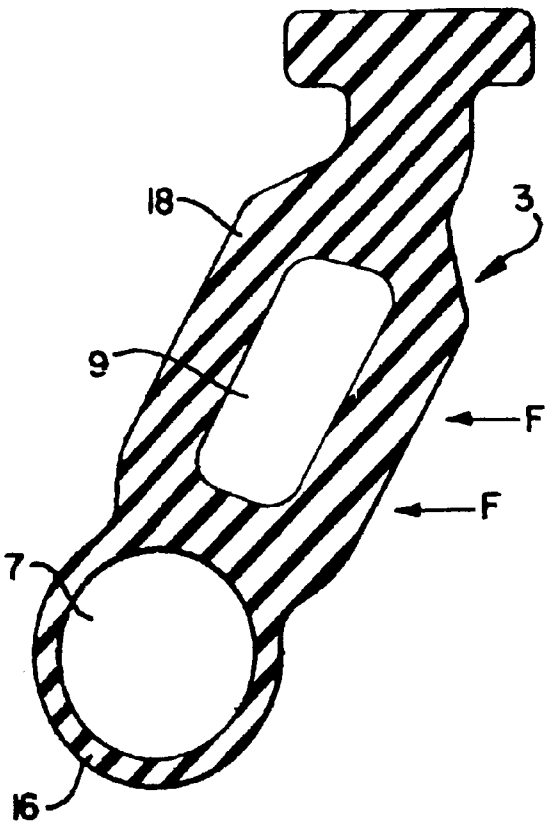
Figure 5A:
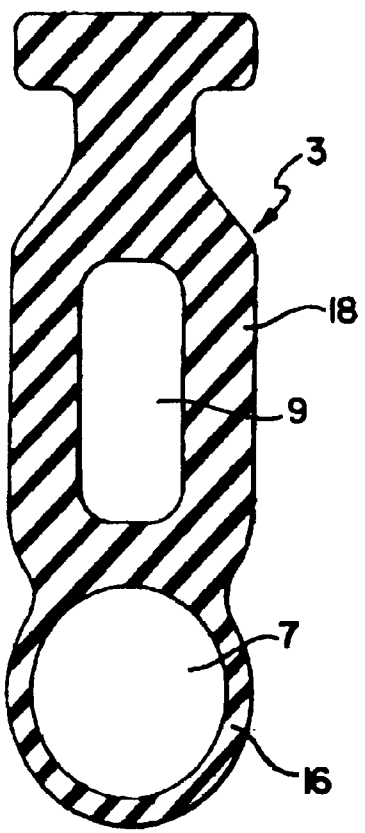

The first and second sensor bodies 16,18 are pneumatically coupled to a fluid pressure sensor 22. The pressure sensor 22 is responsive to changes in the pressure of the fluid in the chambers 7, 9. Specifically, upon sensing a change in pressure, the pressure sensor generates a signal indicative of the change. Such pressure sensors are of the type generally known in the art. The signal is subsequently communicated, in some form, to the controller at which point the controller causes the door body 10 to respond in a predetermined manner. In the preferred embodiment, the chambers 7,9 contains air which has been charged at atmospheric pressure. However, the chambers 7,9 may be filled with any fluid suitable to provide a change in pressure upon receiving an impact in excess of a predetermined force. According to this embodiment of the present invention, the second chamber 9 has a generally rectangular cross section. The parallelogram shape of the second chamber 9 allows the second pneumatic sensor body 18 to be sufficiently rigid to absorb impact parallel to the safety edge 1 without causing complete deformation of the second chamber 9. As illustrated in FIGS. 5A–C, the natural angles of the rectangular shaped second chamber 9, however, tend to allow the second chamber 9 to deflect under forces applied perpendicular to the safety edge 1. This deflection results in sufficient volumetric deformation of the second chamber 9 to actuate the associated pressure sensor 22.

Thus, by providing rigidity through geometric configuration, the safety edge 1 maintains a degree of integrity, allowing the safety edge 1 to absorb parallel impact that may result form door over-travel; while simultaneously providing a safety system responsive to multi-directional impact. It is contemplated that the cross-section of the second sensor body 18 in this embodiment be any parallelogram capable of responding to loads in a direction perpendicular to the safety edge 1 as described above.

According to a preferred embodiment of the invention, the extrudate 3 is extruded from foam. This foam may be closed cell medium/soft density ethylene propylene (EPT) foam, or any other foam suitable to provide both structural integrity and flexibility when used in connection with the applications described herein. Likewise, while foam allows for both suitable structural integrity and flexibility, it is contemplated that the extrudate 3 be extruded from any material that provides these characteristic in combination.

Alternatively, the disparity in the sensitivity of the first and second sensor bodies 16, 18 may be due to the type of the first sensor body 16 vis-á-vis the second sensor body 18. For example, in the embodiment of the invention shown in FIGS. 6–9, the first sensor body 16 includes a first mechanical actuator and the second sensor body 18 includes a second and structurally distinguishable of mechanical actuator. FIG. 6 illustrates one type of actuator that may be employed in the sensor bodies 16,18. The actuator shown in FIG. 6 includes a sensing circuit 24 having at least one mechanically deflectable element 26. The deflectable element 26 is positioned within at least a portion of the sensor body 16, 18 such that an impact to the sensor body 16,18 in excess of a predetermined force will deflect the deflectable element 26. The deflection of the deflectable element 26 changes the electrical state of the sensing circuit 24. A signal indicative of the change in the sensing circuit 24 is generated. Such signal is subsequently communicated to the controller, thereby causing the door body 10 to respond in a predetermined manner. The signal may be transmitted to the controller directly, or the signal may be conditioned or converted by some appropriate intermediate means.

It is contemplated that the change in the sensing circuit 24 be created by one of various types of electrical phenomenon. For example, the deflectable element 26 may be a piezoelectric element, wherein the deflection of the piezoelectric element results in a change in voltage in the circuit 24. Alternatively, the deflectable element 26 may be made from a material which, upon deflection, results in a change in the inductance of the circuit 24.

As shown in FIG. 8, the sensing circuit 24 may also include a second deflectable element 28 disposed adjacent the first deflectable element 26, wherein either the first or second deflectable elements 26,28 is coupled to a power source (not shown). The first and second deflectable elements 26,28 are oriented such that when the sensor body 16,18 receives an impact in excess of a predetermined force, either the first or second deflectable elements 26,28 is deflected toward the other deflectable element 26,28 in such a manner as to change the electrical state of the circuit 24. In this configuration, the sensing circuit 24 is normally an open circuit. Deflection of the deflectable elements 26,28, one toward the other, results in conductively closing the circuit 24. Closure of the circuit 24 causes a signal to be generated, which is in turn transmitted in some form to the controller.

Figure 9:
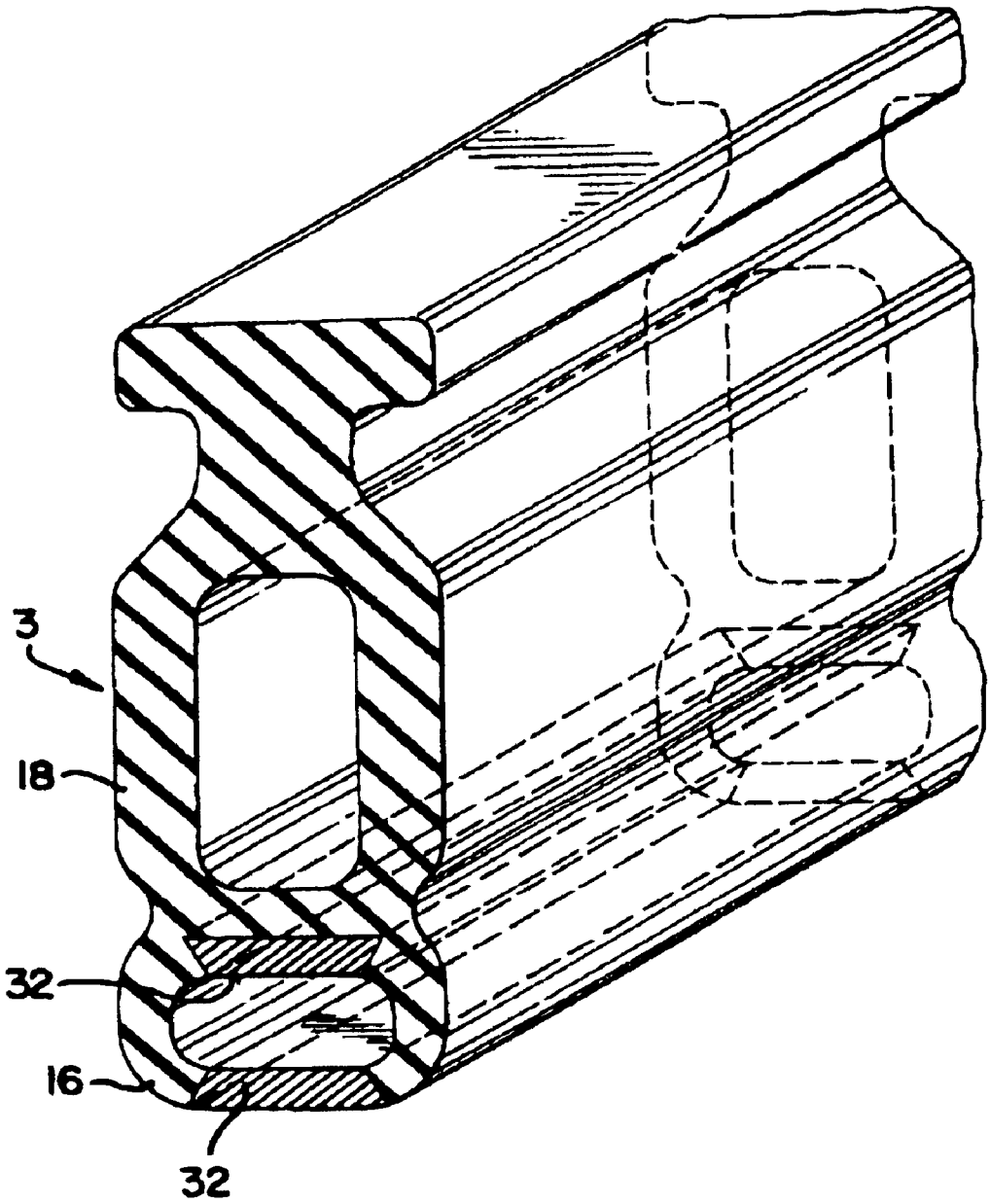

As shown in FIG. 9, the deflectable element 26 may also be a conductive polymer 32 that defines at least a portion of the sensor body 16,18. When the sensor body 16,18 is impacted by a force in excess of a predetermined amount, the conductive polymer 32 deflects in such a manner that the electrical state of the polymer 32 is changed. The conductive polymer 32 may be of the type described in U.S. Pat. No. 5,060,527, generally marketed by Matamatic, Inc. Again, the change in electrical state of the polymer 32 generates a signal indicative of the change which, in turn, is transmitted to the controller.

While the specific embodiments have been illustrated and described, numerous modifications come to mind without significantly departing from the spirit of the invention and the scope of protection is only limited by the scope of the accompanying claims.

We claim:

1. A safety edge for attaching to a bottom edge of a door that is selectively movable up and down to open and close an opening, the safety edge comprising:

a foam extrudate having a first chamber and second chamber disposed above the first chamber, the first and second chambers being integrally formed in the extrudate, wherein the first chamber comprises a first pneumatic sensor body and the second chamber comprises a second pneumatic sensor body, each pneumatic sensor body being responsive to an impact, the first pneumatic sensor body having a greater sensitivity to impact parallel to the first pneumatic sensor body than the second pneumatic sensor body and the second pneumatic sensor body having a greater sensitivity to impact perpendicular to the safety edge than the first pneumatic sensor body.

2. The safety edge of claim 1, wherein the first pneumatic sensor body has a greater sensitivity to impact parallel to the first pneumatic sensor body than the second pneumatic sensor body and the second pneumatic body has a greater sensitivity to impact perpendicular to the safety edge than the first pneumatic sensor body.

3. The safety edge of claim 2, wherein the second chamber has a generally rectangular cross section.

4. The safety edge of claim 1, wherein the first and second pneumatic sensor bodies are each pneumatically coupled to a fluid pressure sensor, the pressure sensor being responsive to changes in fluid pressure and generating a signal indicative of said changes in pressure.

5. The safety edge of claim 4, wherein the first pneumatic sensor body and the second pneumatic sensor body are in electrical communication with a door controller.

6. The safety edge of claim 4, wherein the second pneumatic sensor body is sufficiently rigid to absorb impact parallel to the safety edge without causing complete deformation of the second chamber, but sufficiently deformable to actuate the second pressure sensor upon receiving an impact perpendicular to the safety edge.

7. The door assembly of claim 1, wherein the first and second chambers are formed in integrated cooperative redundancy.

8. A door assembly comprising:

a door body having a bottom edge, the door body being selectively movable up and down to open and close an opening; and an extrudate attached to the bottom edge of the door body, the extrudate being extruded from a deformable and resilient material and comprising a first chamber and second chamber disposed above the first chamber, the first and second chambers being integrally formed in the extrudate, wherein the first chamber comprises a first pneumatic sensor body and the second chamber comprises a second pneumatic sensor body, each pneumatic sensor body being responsive to an impact, the first pneumatic sensor body having a greater sensitivity to impact parallel to the first pneumatic sensor body than the second pneumatic sensor body and the second pneumatic sensor body having a greater sensitivity to impact perpendicular to the safety edge than the first pneumatic sensor body.

9. The door assembly of claim 8, wherein the first and second chambers are formed in integrated cooperative redundancy.

10. The door assembly of claim 8, wherein the second chamber has a generally rectangular cross section.

11. The door assembly of claim 8, wherein the first and second pneumatic sensor bodies are each pneumatically coupled to a fluid pressure sensor, the pressure sensor being responsive to changes in fluid pressure and generating a signal indicative of said changes in pressure.

12. The door assembly of claim 11, wherein the first pneumatic sensor body and the second pneumatic sensor body are in electrical communication with a door controller.

13. The door assembly of claim 11, wherein the second pneumatic sensor body is sufficiently rigid to absorb impact parallel to the safety edge without causing complete deformation of the second chamber, but sufficiently deformable to actuate the second pressure sensor upon receiving an impact perpendicular to the safety edge.

14. A door assembly comprising:

a door body having a bottom edge, the door body being selectively movable up and down to open and close an opening; and, an extrudate attached to the bottom edge of the door body, the extrudate being extruded from a deformable and resilient material comprising a first chamber and second chamber, the first and second chambers being integrally formed in the extrudate, wherein the first chamber comprises a first pneumatic sensor body and the second chamber comprises a second pneumatic sensor body, each pneumatic sensor body being responsive to an impact, the first pneumatic sensor body having a greater sensitivity to impact parallel to the first pneumatic sensor body than the second pneumatic sensor body and the second pneumatic sensor body having a greater sensitivity to impact perpendicular to the safety edge than the first pneumatic sensor body.

15. A door assembly comprising:

a door body having a bottom edge, the door being selectively movable up and down to open and close an opening; and, an extrudate attached to the bottom edge of the door body, the extrudate defining a safety edge and being extruded from a deformable and resilient material, the extrudate having a first and second chamber integrally formed in the extrudate, wherein the first chamber comprises a first sensor body and the second chamber comprises a second sensor body, each sensor body being responsive to an impact;

wherein at least one of the first and second sensor bodies includes a sensing circuit, the circuit having at least one mechanically deflectable element, the deflectable element being positioned such that an impact to the sensor body in excess of a predetermined force will deflect the deflectable element sufficiently to change the electrical state of the sensing circuit and generate a signal indicative of said change, and wherein the deflectable element is a conductive polymer that structurally defines at least a portion the sensor body, the polymer changing its electrical properties when deflected by impact.

* * * * *